US010329805B2

(12) United States Patent
Bacon et al.

(10) Patent No.: US 10,329,805 B2
(45) Date of Patent: Jun. 25, 2019

(54) LOCK HASP

(71) Applicant: BAUER PRODUCTS, INC., Grand Rapids, MI (US)

(72) Inventors: Bruce C. Bacon, Rockford, MI (US); Daren Allen Rathbun, Coldwater, MI (US)

(73) Assignee: BAUER PRODUCTS, INC., Grand Rapids, MI (US)

( * ) Notice: Subject to any disclaimer, the term of this patent is extended or adjusted under 35 U.S.C. 154(b) by 183 days.

(21) Appl. No.: 15/399,894

(22) Filed: Jan. 6, 2017

(65) Prior Publication Data

US 2018/0195316 A1 Jul. 12, 2018

(51) Int. Cl.

| | |
|---|---|
| ***E05B 77/44*** | (2014.01) |
| ***E05B 67/38*** | (2006.01) |
| ***E05B 73/00*** | (2006.01) |

(52) U.S. Cl.

CPC ..... *E05B 77/44* (2013.01); *E05B 67/383* (2013.01); *E05B 73/00* (2013.01)

(58) Field of Classification Search

CPC ..... E05B 77/44; E05B 67/383; E05B 70/00; E05B 73/0005; F16K 35/10; F16K 35/06; B65D 55/14; B60K 15/0409; B60B 7/16; B60D 1/60; F16B 41/005

USPC ..... 70/1, 2, 14, 18, 19, 158, 163, 164, 167, 70/177, 232; 411/111–113

See application file for complete search history.

(56) References Cited

U.S. PATENT DOCUMENTS

| | | | | |
|---|---|---|---|---|
| 1,065,896 | A * | 6/1913 | Carter | B65D 55/14 215/207 |
| 1,760,977 | A * | 6/1930 | Duffy | F16B 41/005 70/231 |
| 1,885,324 | A | 11/1932 | Bjornson | |
| 2,198,079 | A * | 4/1940 | Ferris | E05B 67/383 292/143 |
| 2,566,816 | A * | 9/1951 | Work | B65D 39/12 220/210 |
| 3,181,523 | A * | 5/1965 | Casey | H01T 13/06 123/169 PH |
| 3,399,553 | A | 9/1968 | Lehto | |
| 3,950,971 | A * | 4/1976 | Karls | B65D 55/14 70/164 |

(Continued)

FOREIGN PATENT DOCUMENTS

CA 2200034 9/1997

*Primary Examiner* — Suzanne L Barrett

(74) *Attorney, Agent, or Firm* — Price Heneveld LLP

(57) ABSTRACT

A restraint device for restraining and securing a portable liquid propane gas tank comprises a regulator bracket disposed above a crossbar, wherein an upper first threaded exposed end of a vertically extending shaft extends through the regulator bracket, a locking nut disposed above the regulator bracket, wherein the locking nut threadingly engages the upper first threaded exposed end of the vertically extending shaft, and a lock hasp disposed above the locking nut. The lock hasp comprises a central portion and a flange depending downwardly from a first side of the central portion of the lock hasp and through a slot in the regulator bracket, the flange having an opening at a distal portion thereof through which a shackle of a removable locking device may be inserted to secure the gas tank within the restraint device.

19 Claims, 4 Drawing Sheets

(56) References Cited

U.S. PATENT DOCUMENTS 3,960,168 A * 6/1976 Plympton ..... F16K 35/10 137/385
3,998,078 A 12/1976 Detwiler
4,254,888 A 3/1981 Chandler
4,284,300 A * 8/1981 Campbell ..... F16B 41/005 292/251
4,498,320 A * 2/1985 Mullis ..... F16K 35/06 70/177
4,513,773 A 4/1985 Hardiman, Jr.
4,577,884 A * 3/1986 Harris ..... B60D 1/065 280/507
4,836,570 A * 6/1989 Lopez ..... B60D 1/60 280/507
5,238,141 A 8/1993 Callegari et al.
5,469,726 A 11/1995 Rushing
5,700,024 A * 12/1997 Upchurch ..... B60D 1/60 280/507
6,016,834 A 1/2000 Leidl
6,062,583 A * 5/2000 Lauricella, Jr. ..... B60D 1/06 280/507
6,213,134 B1 4/2001 Pike
6,692,045 B1 * 2/2004 Mc Call, Jr. ..... B65D 55/14 292/281
7,273,223 B2 * 9/2007 Irgens ..... B60D 1/06 280/511
7,634,878 B1 * 12/2009 Motosko ..... E05B 67/383 292/281
8,556,288 B1 * 10/2013 Bale ..... B60D 1/60 280/507
8,806,906 B1 * 8/2014 Bagby ..... F16K 35/06 137/385
9,308,815 B2 4/2016 Torres et al.
9,328,927 B2 5/2016 Wang
2003/0024284 A1 * 2/2003 Erickson ..... F16K 35/06 70/177
2004/0129311 A1 7/2004 Courtney
2012/0211682 A1 8/2012 Shiao et al.
2014/0314520 A1 * 10/2014 Friedman ..... F16B 37/14 411/367
2015/0252835 A1 * 9/2015 Daehler ..... F16B 41/005 411/136
2016/0223204 A1 8/2016 Wang

* cited by examiner

LOCK HASP

FIELD OF THE INVENTION

The present invention generally relates to an improved restraint device for use in restraining and securing one or more liquid propane gas tanks of the kind that are mounted on motor vehicles and trailers and, more particularly, to a liquid propane gas tank restraining device having a lockable lock hasp adapted to engage a bracket to secure a locking nut.

BACKGROUND OF THE INVENTION

Motor vehicles and trailers that might be towed by motor vehicles often employ the use of portable liquid propane gas tanks. For example, in the case of trailers, such portable liquid propane gas tanks may be mounted to a forward portion of the trailer above a trailer hitch structure, also referred to as the towing tongue or coupler, which is used to attach the trailer to the motor vehicle. Often, such an arrangement further includes gas distribution system access valve(s) by which the portable liquid propane gas tanks may be individually or in tandem attached to the gas distribution system of the trailer. For reasons of convenience and safety, these portable liquid propane gas tanks are often mounted outside of the trailer and exposed to the environment. As such, these portable liquid propane gas tanks are often placed in exposed locations where they may be stolen. A device for retaining and securing such portable liquid propane gas tanks is desired.

SUMMARY OF THE INVENTION

According to one aspect of the present invention, a restraint device for securing an object, the restraint device comprises a base upon which the object to disposed, a shaft having an upper first threaded exposed end and a second opposed lower end rigidly mounted relative to the base, a crossbar in juxtaposed relation with the object, the crossbar having an opening through which is received the upper first threaded exposed end of the shaft, a bracket in juxtaposed relation with the crossbar, the bracket having an opening through which is received the upper first threaded exposed end of the shaft, a threaded locking nut in juxtaposed relation with the bracket, the threaded locking nut having a threaded opening through which is received the upper first threaded exposed end of the shaft and which threadingly engages the upper first threaded exposed end of the shaft, and a lock hasp in juxtaposed relation with the threaded locking nut. The lock hasp has an opening through which is received the upper first threaded exposed end of the shaft and a restraining member, wherein the restraining member extends through an offset opening in the bracket and the restraining member has a shackle opening through which a shackle of a removable locking device may be inserted to secure the object within the restraint device.

According to another aspect of the present invention, a restraint device for restraining in securing a portable liquid propane gas tank comprises a base upon which the portable liquid propane gas tank is supported, a vertically extended shaft having an upper threaded exposed end extending up from the base on which the portable liquid propane gas tank is supported, a horizontal crossbar extending above and restraining the portable liquid propane gas tank, wherein the vertically extending shaft extends through the horizontal crossbar, a regulator bracket disposed above the crossbar, wherein the regulator bracket further comprises a regulator mount and the vertically extending shaft extends through the regulator bracket, a locking nut disposed above the bracket, wherein the locking nut threadingly engages the upper first threaded exposed threaded exposed end of the vertically extending shaft, and a lock hasp disposed above the locking nut, wherein the lock hasp comprises a central portion and a flange extending downwardly from a first side of the central portion of the lock hasp and through a slot in the regulator bracket, the flange having an opening at a distal portion thereof through which a shackle of a removable locking device may be inserted to secure the gas tank within the restraint device.

According to yet another aspect of the present invention, a locking device is disclosed for a restraint device for restraining and securing a portable liquid propane gas tank disposed upon a portable liquid propane gas tank support structure of a recreational vehicle comprising a base upon which the portable liquid propane gas tank is supported, a vertically extended shaft having a threaded exposed end extending up from the base on which the portable liquid propane gas tank is supported, and a horizontal crossbar extending above and restraining the portable liquid propane gas tank, wherein the threaded exposed end of the vertically extending shaft extends through the horizontal crossbar. The locking device comprises a regulator bracket disposed above the crossbar, wherein the threaded exposed end of the vertically extending shaft extends through the regulator bracket, a locking nut disposed above the regulator bracket, wherein the locking nut threadingly engages the threaded exposed end of the vertically extending shaft, and a lock hasp disposed above the locking nut, wherein the lock hasp comprises a central portion and a flange extending downwardly from a first side of the central portion of the lock hasp and through a slot in the regulator bracket. The flange has an opening at a distal portion thereof through which a shackle of a removable locking device may be inserted to secure the gas tank within the restraint device.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
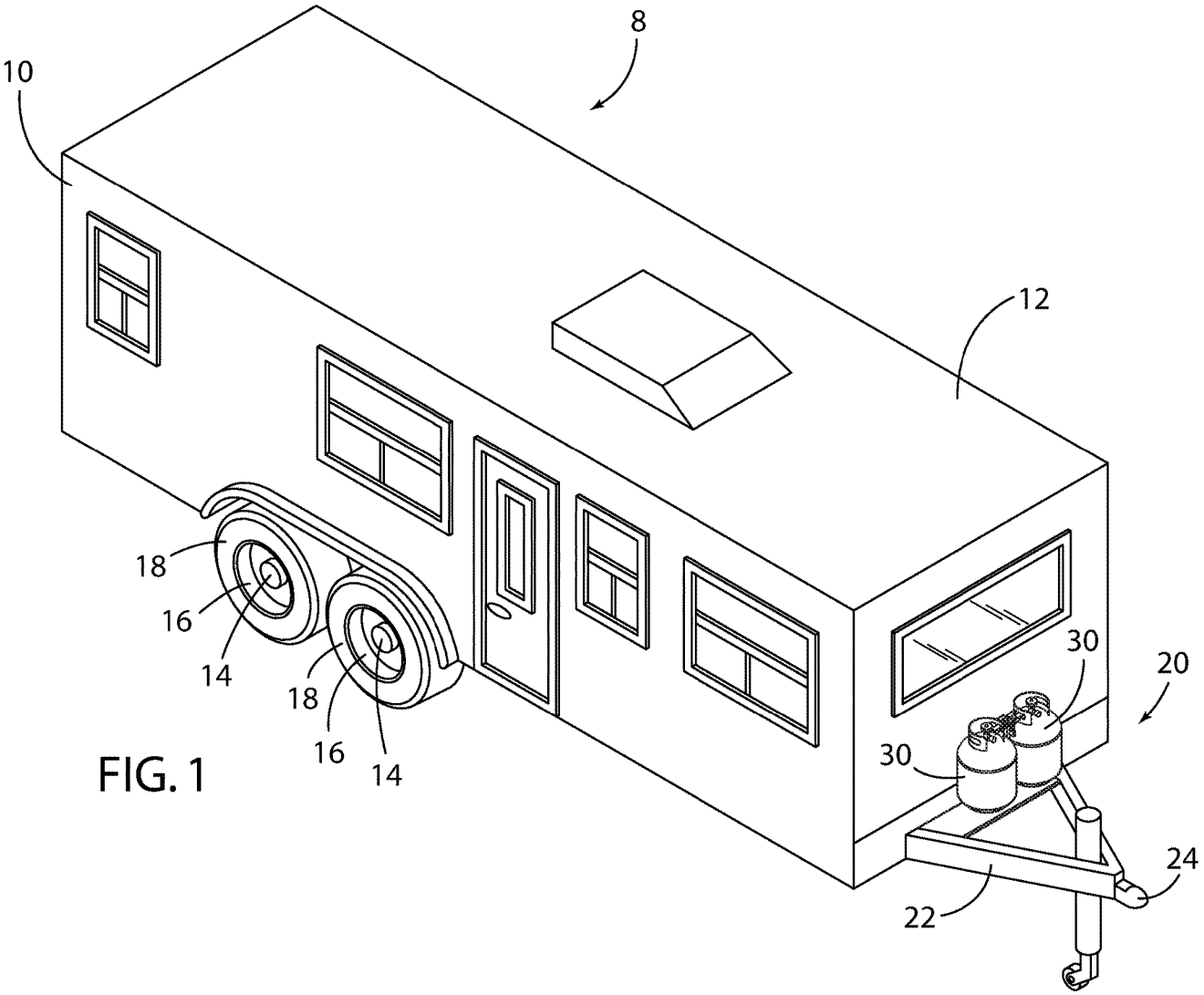
FIG. 1 is a perspective view of an embodiment of a recreational vehicle provided with the improved restraining device of the present disclosure.

For purposes of description herein, the terms "upper," "lower," "right," "left," "rear," "front," "vertical," "horizontal," "interior," "exterior," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawing, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, a representative embodiment of a recreational vehicle 8 in accordance with the present disclosure is disclosed and depicted as a towable trailer 10 having a main enclosed structure 12, within which living quarters or storage space, or combination thereof, may be provided. The trailer 10, as is known, is supported by one or more axle assemblies 14, which include attached wheels 16 and tires 18. A forward portion 20 of the main enclosed structure 12 of the trailer 10, as is typical, is provided with the tongue 22 to which a hitch ball coupler 24 is disposed at a distal end thereof. A hitch ball mounted on the motor vehicle (not shown) designated to tow the trailer 10 is received within the hitch ball coupler 24 to couple the trailer 10 to the motor vehicle.

Often, such trailers 10 are provided with one or more portable liquid propane gas tanks 30, often arranged in pairs, which are typically mounted to and above the tongue 22 proximate the forward portion 20 of the main enclosed structure 12. It should be appreciated that other towable recreational vehicles 8 having other configurations, such as so-called fifth wheel trailers, and recreational vehicles 8 that may be self-propelled, such as motor coaches, are often equipped with one or more such portable liquid propane gas tanks 30 that might advantageously employ the improvement of the present disclosure.

Figure 2:
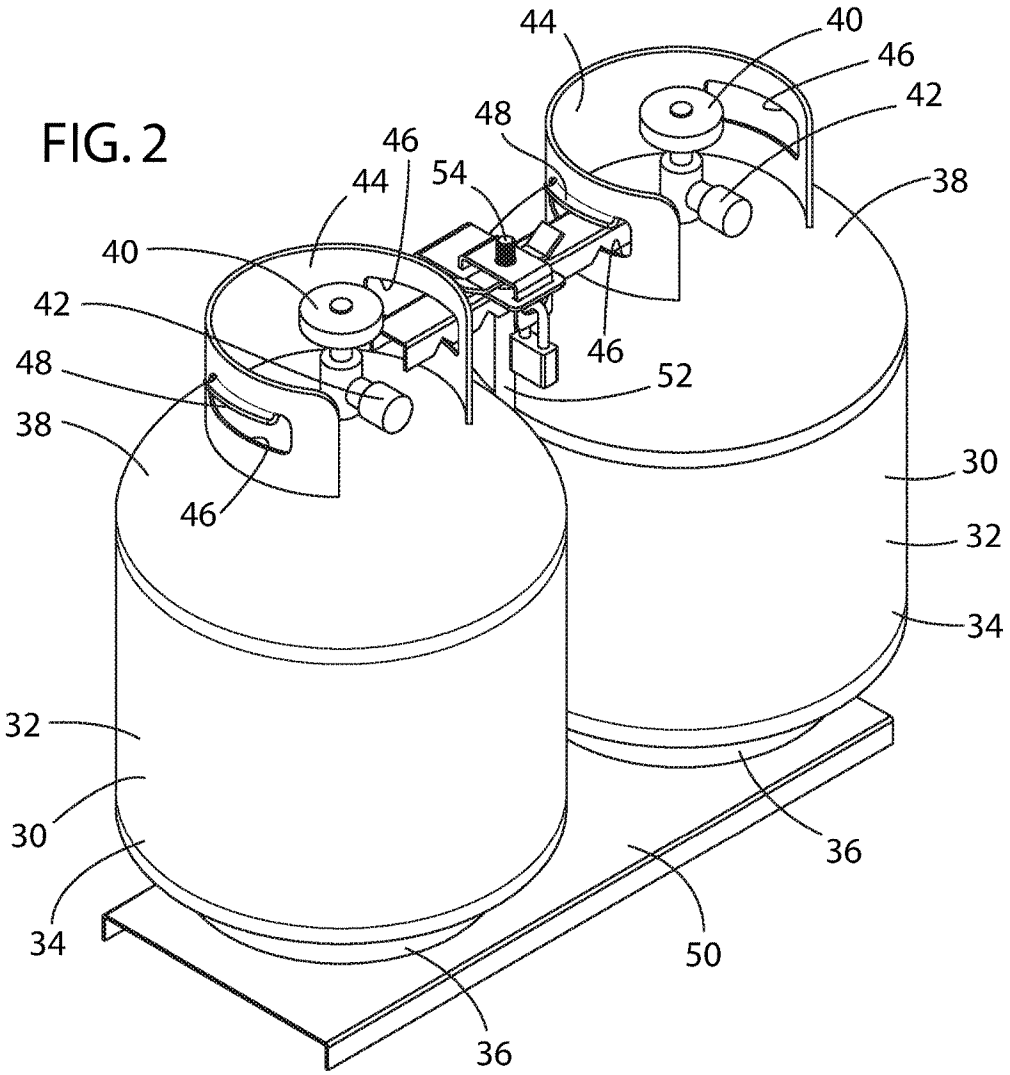
FIG. 2 is an assembled perspective view of a pair of portable liquid propane gas tanks restrained in accordance with the improved restraining device of the present disclosure.
Figure 3:
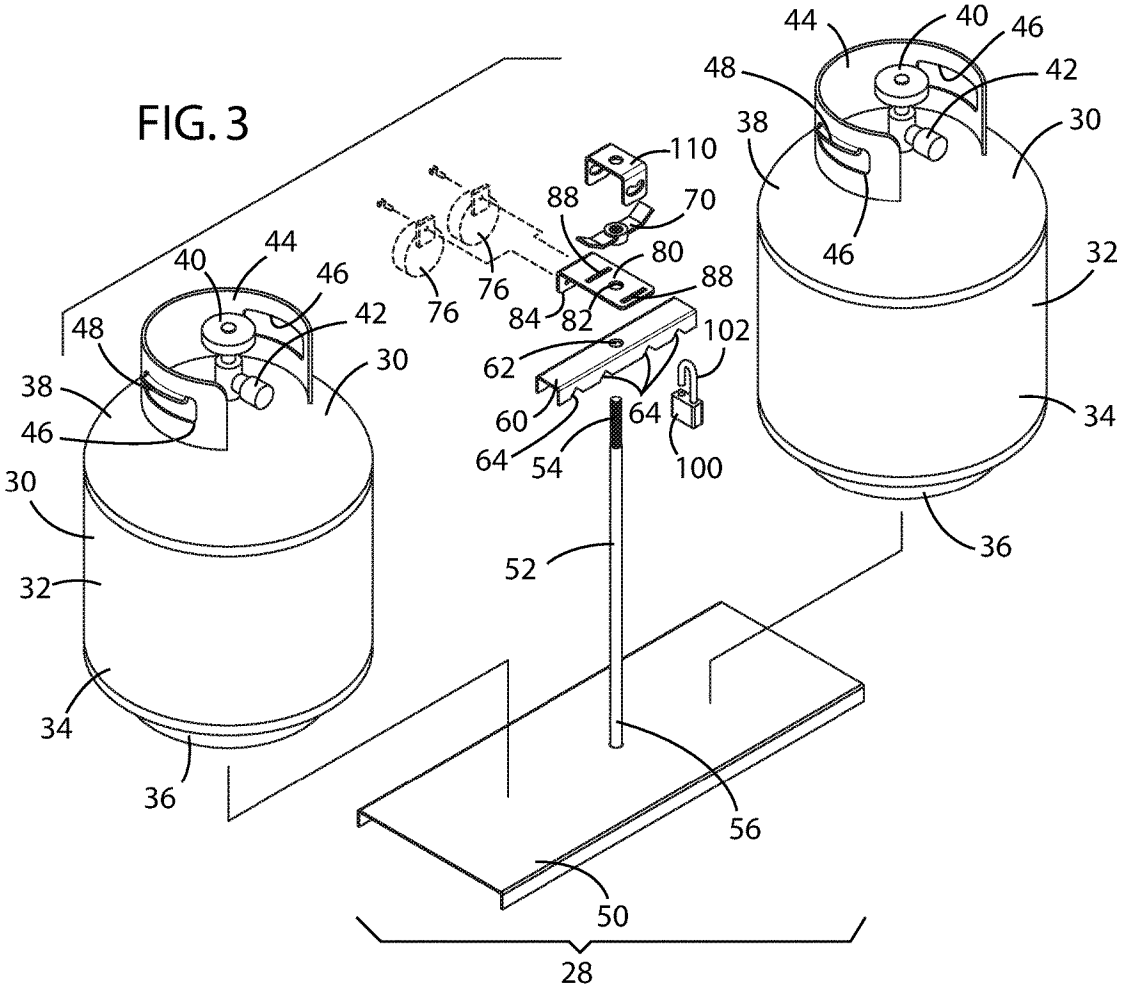
FIG. 3 is an exploded perspective view of a pair of portable liquid propane gas tanks restrained in accordance with the improved restraining device of the present disclosure.

As best seen in FIGS. 2 and 3, the portable liquid propane gas tanks 30 generally comprise an elongated and sealed steel cylindrical body 32 within which the liquid propane is stored. A lower portion 34 of the portable liquid propane gas tank 30 is typically provided with a welded-on circular steel foot ring 36 upon which the portable liquid propane gas tank 30 sits. An upper portion 38 of the portable liquid propane gas tank 30 is typically provided with a valve 40 through which the portable liquid propane gas tank 30 is charged with fresh liquid propane and through which the propane gas is metered through a regulator control valve 42 to a propane distribution system, as further discussed herein. An upper steel collar 44 is normally welded to the upper portion 38 of the portable liquid propane gas tank 30 and partially about the valve 40. The upper steel collar 44 extends above the height of the valve 40 and is thereby situated to protect the valve 40 from damage during transit or handling of the portable liquid propane gas tank 30. The upper steel collar 44 is also usually provided with cutouts 46 on either side of the collar that are flared outwardly on an upper portion thereof to provide a handgrip 48 for handling the portable liquid propane gas tank 30.

As shown in FIGS. 2 and 3, the portable liquid propane gas tanks 30 are commonly disposed upon a portable liquid propane gas tank restraint device 28 of the recreational vehicle 8, which typically comprises a horizontally oriented base 50 upon which the liquid propane gas tanks 30 are supported. The base 50 is often mounted on or proximate the tongue 22 of the trailer 10, as best shown in FIG. 1. A vertically extended shaft 52 is situated alongside the portable liquid propane gas tanks 30 and extends upwardly from the base 50 on which the liquid propane gas tank 30 is supported. The vertically extended shaft 52 typically has an upper first threaded exposed end 54 and a second opposed lower end 56, the latter being rigidly mounted relative to the base 50. It should be appreciated that the entire length of the vertically extending shaft 52 may be threaded or only the upper first threaded exposed end 54 may be threaded. Likewise, it should be appreciated that the second opposed lower end 56 of the vertically extending shaft 52 can be rigidly attached to a structure other than the base 50, such as the tongue 22 of the recreational vehicle 8, so long as the base 50 is operably coupled with such other structure. It should further be appreciated that the second opposed lower end 56 of the vertically extending shaft 52 should be fixedly secured, such as by welding, to either the base 50 or such other structure so as not to defeat the theft deterrent benefits of the present disclosure.

As likewise shown in FIGS. 2 and 3, the portable liquid propane gas tank restraint device 28 also includes a horizontal crossbar 60 that extends above and in juxtaposed relation with one of the cutouts 46 of the upper steel collar 44 of each of the pair of portable liquid propane gas tanks 30 for restraining the portable liquid propane gas tanks 30, particularly when the trailer 10 is in motion. The crossbar 60 has an opening 62 through which is received the upper first threaded exposed end 54 of the vertically extending shaft 52 and is commonly provided with a series of notches 64 regularly disposed along its horizontal length that are designed to engage the a lower edge of the cut out 46 of the upper steel collar 44 on the upper portion 38 of the portable liquid propane gas tanks 30, as shown in FIGS. 2 and 3. The upper first threaded exposed end 54 of the vertically extending shaft 52 thus extends through the crossbar 60 and is secured via a threaded locking nut 70 threadingly engaging the upper first threaded exposed end 54 of the vertically extending shaft 52. Once the threaded locking nut 70 is tightened against the crossbar 60, the portable liquid propane gas tanks 30 are effectively sandwiched between the base 50 and the crossbar 60 and are effectively secured.

The portable liquid propane gas tanks 30 are operationally coupled with a liquid propane gas delivery system (not shown) that delivers propane gas to the various devices within the trailer 10 that consume propane gas, such as the stove, refrigerator, furnace, and water heater. In order to deliver this propane gas at the proper pressures, one or more propane gas pressure regulator(s) 76 are typically employed and mounted to a regulator bracket 80 attached to or near the center of the crossbar 60 proximate the upper first threaded exposed end 54 of the vertically extending shaft 52. In practice, only one of the portable liquid propane gas tanks 30 is usually in fluid communication with the gas delivery system at a time, with the second of the portable liquid propane gas tanks 30 being held in reserve.

In most circumstances, recreational vehicles 8, such as trailer 10, are delivered to dealerships throughout the nation with the portable liquid propane gas tanks 30 installed at the factory. However, in order to prevent the theft of the portable liquid propane gas tanks 30 from the recreational vehicles 8 as they are stored at the dealership lot, it is often necessary for dealership personnel to remove the portable liquid propane gas tanks 30 from the recreational vehicle 8, store the portable liquid propane gas tanks 30 inside a secure location at the dealership, and then reinstall the portable liquid propane gas tanks 30 upon the sale of the recreational vehicle 8. Each of these steps represents an otherwise wasteful labor cost to the recreational vehicle dealership. In addition, after the recreational vehicle 8 is sold and put into service, owners are interested in making sure that the portable liquid propane gas tanks 30 cannot be stolen from the recreational vehicle 8 when the recreational vehicle 8 is left unattended.

Current portable liquid propane gas tank locking devices, however, tend to be difficult to use. For example, chains and steel cables are often used in combination with portable padlocks to couple the portable liquid propane gas tanks 30 to the base 50 of the portable liquid propane gas tank restraint device 28 or the tongue 22 of the recreational vehicle 8. However, such approaches tend to be cumbersome. Thus, dealers and owners are presented with the challenge of effectively and efficiently protecting the portable liquid propane gas tanks 30 mounted on recreational vehicles 8.

The improved locking device 90 disclosed herein allows one or more portable liquid propane gas tanks 30 to be readily restrained and preferably secured to the portable liquid propane gas tank restraint device 28 with a portable padlock 100, that can be readily installed and removed by either the dealership and the ultimate owner for the recreational vehicle 8. According to the improvement disclosed herein, an improved regulator bracket 80 is disposed above and in juxtaposed relation with the crossbar 60, where the regulator bracket 80 is likewise provided with an opening 82 in the regulator bracket 80 through which the upper first threaded exposed end 54 of the vertically extending shaft 52 extends through the regulator bracket 80. The regulator bracket 80 preferably further comprises a regulator mount 84 to which the gas pressure regulator(s) 76 is mounted. Preferably, the regulator bracket 80 generally includes an upper planar portion 86 disposed above and proximate the center of the crossbar 60. The opening 82 is provided through the upper planar portion 86 through which the upper first threaded exposed end 54 of the vertically extending shaft 52 is received. One or more offset openings 88, 88', each preferably shaped as a slot, are disposed on either side of the central opening 82 of the upper planar portion 86 of the regulator bracket 80, as will be further discussed below. The regulator bracket 80 further includes a vertical portion 92 in orthogonal relation with the upper planar portion 86 on which is provided the mount 84 to which the gas pressure regulator(s) 76 is mounted.

Figure 5:
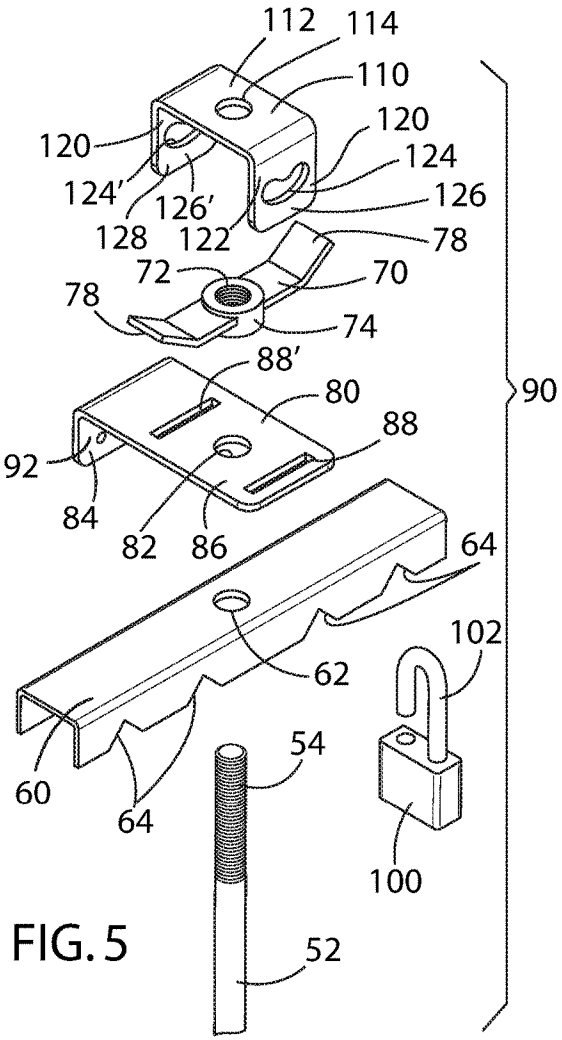
FIG. 5 is an exploded perspective view of the improved restraining device of the present disclosure.
Figure 4:
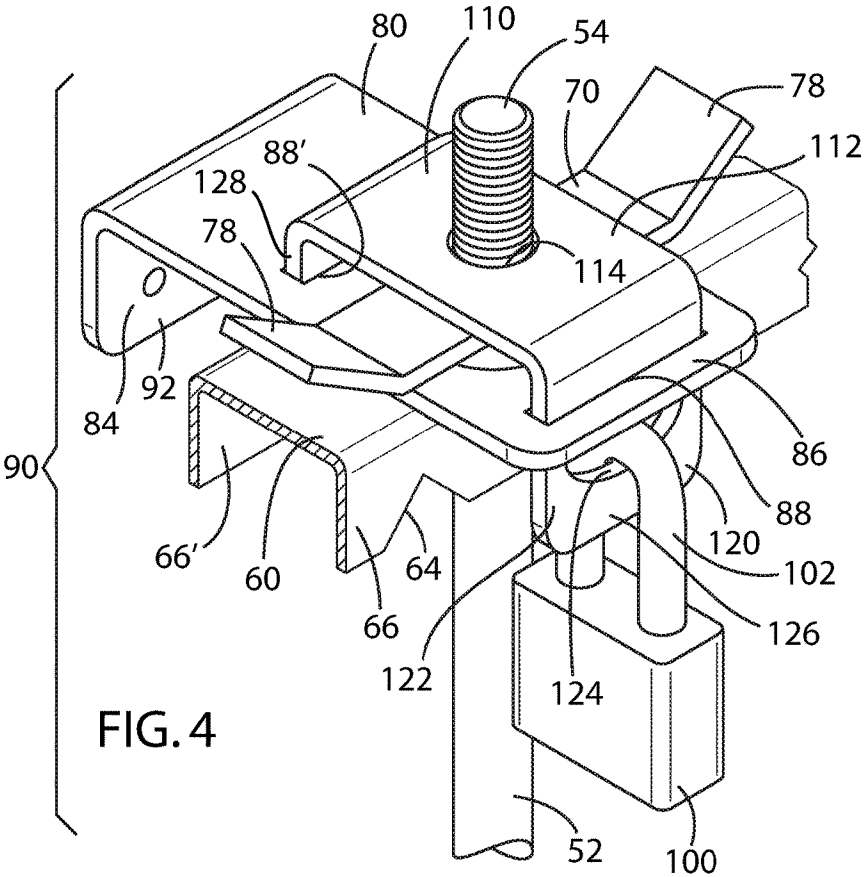
FIG. 4 is an assembled perspective view of the improved restraining device of the present disclosure.

The threaded locking nut 70 is disposed above and in juxtaposed relation with the upper planar portion 86 of the regulator bracket 80. The threaded locking nut 70 has a threaded opening 72 which receives and threadingly engages the upper first threaded exposed end 54 of the vertically extending shaft 52. The regulator bracket 80 is thus preferably disposed and sandwiched between the crossbar 60 and the threaded locking nut 70, as shown in FIGS. 4 and 5. Preferably, the threaded locking nut 70 comprises a wingnut having a substantially planar central portion 74 and a pair of inclined wings 78 extending upwardly and laterally outwardly from either side of the planar central portion 74 of the threaded locking nut 70. When the lock hasp 110 described below is assembled with the locking device 90 disclosed herein, the inclined wings 78 effectively prevent access to the planar central portion 74 of the threaded locking nut 70 when the lock hasp 110 is in juxtaposed relation with the threaded locking nut 70.

As noted above, the lock hasp 110 is disposed above and in juxtaposed relation with the threaded locking nut 70. Preferably, the lock hasp 110 comprises a central portion 112 disposed directly above and in juxtaposed relation with the threaded locking nut 70. The central portion 112 of the lock hasp 110 also has an opening 114 through which is received the upper first threaded exposed end 54 of the vertically extending shaft 52 that extends above the threaded locking nut 70 after the threaded locking nut 70 is installed. The lock hasp 110 also includes a restraining member 120 that engages the regulator bracket 80. Preferably, the restraining member 120 extends through and below one of the openings or slots 88, 88' in the regulator bracket 80.

The restraining member 120 preferably comprises a first flange 122 in orthogonal relation with the central portion 112 of the lock hasp 110 and extends downwardly from a first side of the central portion 112 of the lock hasp 110. The first flange 122 is thus adapted to pass through a first slot 88 formed in the regulator bracket 80, wherein the first slot 88 is disposed alongside the opening 82 that receives the upper first threaded exposed end 54 of the vertically extending shaft 52 extending through the regulator bracket 80. In addition, the first flange 122 has an opening 124 at a distal portion 126 thereof through which a shackle 102 of a portable padlock 100 may be inserted. Preferably, the first flange 122 is disposed to extend through the regulator bracket 80 in a forward facing orientation relative the tongue 22 of the trailer 10, thus facilitating ready access to the portable padlock 100.

Further, the lock hasp 110 preferably includes a second flange 128 in orthogonal relation with the central portion 112 of the lock hasp 110 that extends downwardly from an opposed second side of the central portion 112 of the lock hasp 110 and through a second slot 88' in the regulator bracket 80 disposed alongside the central opening 82 opposite the first slot 88. Preferably, the second flange 128 likewise has an opening 124' at a distal portion 126' thereof. As best shown in FIG. 4, the crossbar 60 comprises a pair of opposed sides 66, 66' and each of the first and second flanges 122, 128 depend downwardly from opposed sides of the central portion 112 of the lock hasp 110 and engage one of the opposed sides 66, 66' of the crossbar 60. Accordingly, rotation of the regulator bracket 80 and lock hasp 110 relative the crossbar 60 is prevented when the lock hasp 110 is installed. Further, the inclined wings 78 on the threaded locking nut 70 extending upwardly and laterally outwardly from either side of the planar central portion 74 of the threaded locking nut 70 prevent rotation of the threaded locking nut 70 when the lock hasp 110 is installed.

Once the shackle 102 of the portable padlock 100 is in its locked position, the first flange 122 is thus restrained within the first slot 88, whereby the lock hasp 110 cannot be removed from the upper first threaded exposed end 54 of the vertically extending shaft 52. With the regulator bracket 80 and threaded locking nut 70 otherwise inaccessible and non-rotatable relative the crossbar 60, and the lock hasp 110 secured to the regulator bracket 80 via the first flange 122 on the lock hasp 110, the portable liquid propane gas tank 30 is secured within the portable liquid propane gas tank restraint device 28.

As may be appreciated from the foregoing description, the improved locking device 90 for a portable liquid propane gas tank restraint device 28 disclosed herein provides a lock hasp 110 having a pair of vertically depending flanges 122, 128 that straddle opposed sides of the crossbar 60 and extends through opposed slots 88, 88' in the regulator bracket 80. When the first flange 122 is encumbered with the shackle 102 of the portable padlock 100, the lock hasp 110 is mechanically coupled with the regulator bracket 80, preventing access to the threaded locking nut 70, thereby preventing disassembly of the crossbar 60 from the vertically extending shaft 52 and release of the portable liquid propane gas tanks 30 from the portable liquid propane gas tank restraint device 28.

It should also be appreciated that the lock hasp 110 disclosed herein has a symmetrical configuration, where each of the flanges 122, 128 have an opening 124, 124' through which the shackle 102 of the portable padlock 100 may be received, which greatly contributes to its ease of installation and assembly by both dealership personnel and recreational vehicle owners. Also, the fact that the improved locking device 90 allows ready access to the vertically depending first flange 122 having the opening 124 through which the shackle 102 of the portable padlock 100 is inserted further contributes to the ease and simplicity of the use of the improvement disclosed herein. In sum, the solution disclosed herein provides a simple, efficient, effective, and low-cost solution to restraining and securing portable liquid propane gas tanks 30 on recreational vehicles 8, both prior to and after sale of the recreational vehicle 8.

Finally, it should be appreciated that vehicles other than recreational vehicles 8 that carry metal tanks containing gases other than liquid propane gas might advantageously employ the improvement of the present disclosure. That is, vehicles engaged in the delivery of industrial gases, e.g., acetylene, that are transported in elongated metal tanks having a lower portion 34 and a top portion 38 provided with a upper steel collar 44 that might be restrained between a base 50 and a crossbar 60 may be modified to include and enjoy the features of the present disclosure.

It will be understood by one having ordinary skill in the art that construction of the present disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

For purposes of this disclosure, the term "operably connected" generally means that one component functions with respect to another component, even if there are other components located between the first and second component, and the term "operable" defines a functional relationship between components.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that, unless otherwise described, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating positions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

We claim:

1. A restraint device for securing an object, the restraint device comprising:

a base upon which the object to disposed;

a shaft having in upper first threaded exposed end and a second opposed lower end rigidly mounted relative to the base;

a crossbar in juxtaposed relation with the object, the crossbar having an opening through which is received the upper first threaded exposed end of the shaft;

a bracket in juxtaposed relation with the crossbar, the bracket having an opening through which is received the upper first threaded exposed end of the shaft;

a locking nut in juxtaposed relation with the bracket, the locking nut having a threaded opening through which is received the upper first threaded exposed end of the shaft and which threadingly engages the upper first threaded exposed end of the shaft; and a lock hasp in juxtaposed relation with the locking nut, the lock hasp comprising a central portion having an opening through which is received the upper first threaded exposed end of the shaft and a restraining member further comprising a first flange extending downwardly from a first side of and in orthogonal relation to the central portion of the lock hasp;

wherein the central portion of the lock hasp is disposed above and in juxtaposed relation with the locking nut and the restraining member extends through an offset opening in the bracket and the restraining member has a shackle opening through which a shackle of a removable locking device may be inserted to secure the object within the restraint device.

2. The restraint device of claim 1, wherein the object is one or more portable liquid propane gas tanks.

3. The restraint device of claim 2, wherein the bracket further comprises a mount to which a propane gas pressure regulator is mounted.

4. The restraint device of claim 1, wherein the shaft is mounted to and extends vertically upwardly from the base.

5. The restraint device of claim 4, wherein the base and the crossbar are horizontally orientated and the shaft extends vertically alongside the object.

6. The restraint device of claim 4, wherein the entire shaft is threaded.

7. The restraint device of claim 1, wherein the lock hasp further comprises a second flange extending downwardly from an opposed second side of and in orthogonal relation to the central portion of the lock hasp and through a second offset opening in the bracket.

8. The restraint device of claim 1, wherein the locking nut has a planar central portion and a pair of inclined wings extending upwardly and laterally outwardly from either side of the planar central portion of the locking nut, the pair of inclined wings preventing access to the locking nut when the lock hasp is in juxtaposed relation with the locking nut.

9. The restraint device of claim 1, wherein the restraining member engages a slot in the bracket alongside of the opening in the bracket that receives the upper first threaded exposed end of the shaft.

10. The restraint device of claim 1, wherein the lock hasp has a central portion on which is disposed the opening in the lock hasp that receives the upper first threaded exposed end of the shaft and the restraining member comprises one of a pair of flanges disposed on the lock hasp in orthogonal relation to the central portion of the lock hasp that engage a slot disposed along either side of the opening in the bracket that receives the upper first threaded exposed end of the shaft.

11. A restraint device for restraining in securing a portable liquid propane gas tank comprising:

a base upon which the portable liquid propane gas tank is supported;

a vertically extended shaft having an upper threaded exposed end extending up from the base on which the portable liquid propane gas tank is supported;

a horizontal crossbar extending above and restraining the portable liquid propane gas tank, wherein the vertically extending shaft extends through the horizontal crossbar;

a regulator bracket disposed above the horizontal crossbar, wherein the regulator bracket further comprises a regulator mount and the vertically extending shaft extends through the regulator bracket;

a locking nut disposed above the bracket, wherein the locking nut threadingly engages the upper threaded exposed end of the vertically extending shaft; and a lock hasp disposed above the locking nut, wherein the lock hasp comprises a central portion and a flange extending downwardly from a first side of the central portion of the lock hasp and through a slot in the regulator bracket, the flange having an opening at a distal portion thereof through which a shackle of a removable locking device may be inserted to secure the gas tank within the restraint device.

12. The restraint device of claim 11, further comprising a pair of flanges extending downwardly from opposed sides of the central portion of the lock hasp, wherein each one of the pair of flanges extends downwardly through one of a pair of slots in the regulator bracket.

13. The restraint device of claim 12, wherein the locking nut comprises a planar central portion disposed below the central portion of the lock hasp and a pair of inclined wings extending upwardly and laterally outwardly from either side of the planar central portion of the locking nut, the inclined wings preventing access to the locking nut when the lock hasp is disposed above the regulator bracket.

14. The restraint device of claim 12, wherein the horizontal crossbar comprises a pair of opposed sides and each of the pair of flanges is extending downwardly from opposed sides of the central portion of the lock hasp engage at least one of the pair of opposed sides of the horizontal crossbar, preventing rotation of the regulator bracket and the lock hasp relative the horizontal crossbar.

15. A locking device for a restraint device for restraining and securing a portable liquid propane gas tank to a recreational vehicle, the restraint device comprising a base upon which the portable liquid propane gas tank is supported, a vertically extended shaft having an upper threaded exposed end extending up from the base on which the portable liquid propane gas tank is supported, and a horizontal crossbar extending above and restraining the portable liquid propane gas tank, wherein the upper threaded exposed end of the vertically extending shaft extends through the horizontal crossbar;

wherein the locking device comprises a regulator bracket disposed above the crossbar, wherein the upper threaded exposed end of the vertically extending shaft extends through the regulator bracket, a locking nut disposed above the regulator bracket, wherein the locking nut threadingly engages the upper threaded exposed end of the vertically extending shaft, and a lock hasp disposed above the locking nut, wherein the lock hasp comprises a central portion and a flange extending downwardly from a first side of the central portion of the lock hasp and through a slot in the regulator bracket, the flange having an opening at a distal portion thereof through which a shackle of a removable locking device may be inserted to secure the gas tank within the restraint device.

16. The locking device of claim 15, wherein the locking nut has a planar central portion and a pair of inclined wings extending upwardly and laterally outwardly from either side of the planar central portion of the locking nut, the inclined wings preventing access to the locking nut when the lock hasp is disposed above the locking nut.

17. The locking device of claim 16, wherein the lock hasp further comprises a second flange extending downwardly from an opposed second side of the central portion of the lock hasp and through the regulator bracket.

18. The locking device of claim 15, wherein the regulator bracket further comprises an upper planar portion disposed above the crossbar and a vertical portion in orthogonal relation with the upper planar portion on which is provided a mount to which a propane gas pressure regulator is mounted.

19. A restraint device for securing an object, the restraint device comprising:

a base upon which the object to disposed;

a shaft having in upper first threaded exposed end and a second opposed lower end rigidly mounted relative to the base;

a crossbar in juxtaposed relation with the object, the crossbar having an opening through which is received the upper first threaded exposed end of the shaft;

a bracket in juxtaposed relation with the crossbar, the bracket having an opening through which is received the upper first threaded exposed end of the shaft;

a locking nut in juxtaposed relation with the bracket, the locking nut having a threaded opening through which is received the upper first threaded exposed end of the shaft and which threadingly engages the upper first threaded exposed end of the shaft and having a laterally outwardly extending wing from a central portion thereof; and a lock hasp in vertical juxtaposed relation with the locking nut, the lock hasp comprising a central portion and a flange extending orthogonally from a first side of the central portion of the lock hasp;

wherein the flange extends through an offset slot in the bracket and is thereby placed in juxtaposed and proximate relation with the wing of the locking nut so as to directly and physically interfere with and prevent meaningful rotation of the locking nut, and the flange has a shackle opening through which a shackle of a removable locking device may be inserted to secure the object within the restraint device.

* * * * *